US006927558B2

(12) United States Patent
Kawaguchi et al.

(10) Patent No.: US 6,927,558 B2
(45) Date of Patent: Aug. 9, 2005

(54) POWER SUPPLY VOLTAGE LOWERING CIRCUIT USED IN SEMICONDUCTOR DEVICE

(75) Inventors: Takayuki Kawaguchi, Yokohama (JP); Jin Kashiwagi, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 117 days.

(21) Appl. No.: 10/671,339

(22) Filed: Sep. 25, 2003

(65) Prior Publication Data

US 2005/0012494 A1 Jan. 20, 2005

(30) Foreign Application Priority Data

Jul. 17, 2003 (JP) ..... 2003-198470

(51) Int. Cl.[7] ..... G05F 3/16
(52) U.S. Cl. ..... 323/313; 323/316; 323/281
(58) Field of Search ..... 323/312, 313, 323/314, 315, 316, 270, 274, 275, 280, 281; 327/408, 539, 540, 541

(56) References Cited

U.S. PATENT DOCUMENTS 5,563,546 A * 10/1996 Tsukada ..... 327/408
5,783,935 A * 7/1998 Kyung ..... 323/313

FOREIGN PATENT DOCUMENTS

| | | |
|---|---|---|
| JP | 2001-210076 | 8/2001 |
| JP | 2002-334577 | 11/2002 |
| JP | 2002-373490 | 12/2002 |

* cited by examiner

*Primary Examiner*—Jessica Han
(74) *Attorney, Agent, or Firm*—Hogan & Hartson, LLP

(57) ABSTRACT

A reference voltage generating circuit generates reference voltage and outputs the thus generated reference voltage from an output terminal thereof. A voltage generating circuit lowers external power supply voltage according to the reference voltage supplied from the reference voltage generating circuit to output internal power supply voltage from an output terminal thereof. A transistor has a current path connected between a terminal to which the external power supply voltage is supplied and the output terminal of the voltage generating circuit or between the terminal to which the external power supply voltage is supplied and the output terminal of the reference voltage generating circuit and a gate supplied with constant voltage and has negative threshold voltage.

20 Claims, 7 Drawing Sheets

POWER SUPPLY VOLTAGE LOWERING CIRCUIT USED IN SEMICONDUCTOR DEVICE

CROSS-REFERENCE TO RELATED APPLICATIONS

This application is based upon and claims the benefit of priority from the prior Japanese Patent Application No. 2003-198470, filed Jul. 17, 2003, the entire contents of which are incorporated herein by reference.

BACKGROUND OF THE INVENTION

1. Field of the Invention

This invention relates to a semiconductor device such as a memory having MIS transistors, for example, and more particularly to a power supply voltage lowering circuit.

2. Description of the Related Art

For example, the gate oxide film used in a semiconductor device (which is hereinafter referred to as an LSI) such as a memory device having MIS transistors is made thinner as the element is more miniaturized. External power supply voltage (which is hereinafter referred to as VEXT) applied to this type of LSI is not always changed according to miniaturization of the element. Therefore, high voltage of VEXT determined according to the environment of the user using the LSI is applied to the LSI in some cases. If the high voltage of VEXT is applied to a transistor having a thin gate oxide film in the LSI, the gate oxide film will be destroyed in some cases.

In order to prevent the above problem, a countermeasure for arranging a power supply voltage lowering circuit (which is hereinafter simply referred to as a voltage lowering circuit) in the LSI and lowering VEXT by use of the voltage lowering circuit to generate internal power supply voltage (which is hereinafter referred to as VINT) is taken. Thus, by generating VINT lower than VEXT, the transistor having a thin gate oxide film can be prevented from being destroyed. When VEXT becomes equal to or higher than constant voltage, the voltage of VINT is set to voltage which does not depend on a variation in the voltage of VEXT and a temperature variation and the voltage of VINT becomes equal to a constant value.

As the technique for generating internal power supply voltage based on the external power supply voltage by use of the voltage lowering circuit, for example, a circuit which is turned ON in response to a control signal in a low power consumption mode (deep power down mode) to generate internal power supply voltage lower than the external power supply voltage by threshold voltage VTHN of an NMOS transistor is developed (Jpn. Pat. Appln. KOKAI Publication No. 2002-373490).

Further, a circuit in which a PMOS transistor is turned ON in response to a power-ON reset signal generated at the turn-ON time of the power supply and the external power supply voltage VEXT is forcedly set to the internal power supply voltage VINT in a semiconductor device having a voltage generating circuit which generates the internal power supply voltage based on the external power supply voltage is disclosed (Jpn. Pat. Appln. KOKAI Publication No. 2001-210076).

The conventional voltage lowering circuit includes a reference voltage generating circuit using a band gap reference circuit which generates reference voltage VREF and an internal voltage generating circuit which receives the reference voltage VREF from the voltage generating circuit and generates VINT.

For example, when no access is made to the LSI for a long period of time, the LSI is set in a standby mode in order to suppress the power consumption. When the LSI is set into the standby mode, VEXT is lowered to approximately 1V in some cases in order to suppress a standby current of the LSI. In this case, a voltage of only 0.7V is output as VINT generated from the conventional voltage lowering circuit. Since VINT is also used as the power supply voltage of the memory cell, a voltage of 0.7V is applied to the power supply of the memory cell. For example, the voltage is substantially equal to the threshold voltage VTHN of an N-channel MOS transistor (which is hereinafter referred to as an NMOS transistor) or the threshold voltage |VTHP| of a P-channel MOS transistor (which is hereinafter referred to as a PMOS transistor) which configures a memory cell of a static RAM. Therefore, the data latch ability of the memory cell is weakened. That is, when the threshold voltage VTHN of the NMOS transistor or the threshold voltage |VTHP| of the PMOS transistor which configures the memory cell becomes higher than 0.7V, there occurs a possibility that the NMOS transistor or the PMOS transistor is set into the OFF state and data stored in the memory cell will be lost.

Further, the semiconductor device is required to be miniaturized. Therefore, it is not preferable to increase the circuit scale of the voltage lowering circuit. In order to generate required internal power supply voltage, it is desirable to suppress the number of exclusive control signals and the number of circuits which generate the control signals to the smallest possible value. Therefore, it is desired to develop a semiconductor device which can suppress the internal power supply voltage from becoming lower than the external power supply voltage without using the exclusive control signal in a state such as a standby mode in which the external power supply voltage is set low and enhance the performance of the semiconductor device in the state in which the external power supply voltage is set low.

BRIEF SUMMARY OF THE INVENTION

A semiconductor device according to a first aspect of the invention comprises a reference voltage generating circuit which generates reference voltage based on external power supply voltage, the reference voltage generating circuit outputting the generated reference voltage from an output terminal thereof; a voltage generating circuit whose input terminal is connected to the output terminal of the reference voltage generating circuit, the voltage generating circuit lowering the external power supply voltage according to the reference voltage supplied from the reference voltage generating circuit to output internal power supply voltage from an output terminal thereof; and at least one of first and second transistors provided in the semiconductor device, the first transistor having a current path connected between a terminal to which the external power supply voltage is supplied and the output terminal of the voltage generating circuit and a gate supplied with constant voltage and having negative threshold voltage and the second transistor having a current path connected between a terminal to which the external power supply voltage is supplied and the output terminal of the reference voltage generating circuit and a gate supplied with constant voltage and having negative threshold voltage.

A semiconductor device according to a second aspect of the invention comprises a reference voltage generating circuit having first and second output terminals, the reference voltage generating circuit generating reference voltage based on external voltage, outputting the thus generated reference voltage from the first output terminal, generating a control signal used to control a current source and outputting the thus generated control signal from the second output terminal; a voltage generating circuit whose input terminal is connected to the first output terminal of the reference voltage generating circuit, the voltage generating circuit lowering external power supply voltage according to the reference voltage supplied from the first output terminal of the reference voltage generating circuit to output internal power supply voltage from an output terminal thereof; a first transistor having a current path connected between a terminal to which the external power supply voltage is supplied and the output terminal of the voltage generating circuit and a gate supplied with first voltage and having negative threshold voltage; and at least one of second and third transistors provided in the semiconductor device, the second transistor having a current path connected between a terminal to which the external power supply voltage is supplied and the first output terminal of the reference voltage generating circuit and a gate supplied with second voltage and having negative threshold voltage, and the third transistor having a current path connected between a terminal to which the external power supply voltage is supplied and the second output terminal of the reference voltage generating circuit and a gate supplied with constant voltage and having negative threshold voltage.

A semiconductor device according to a third aspect of the invention comprises a reference voltage generating circuit which generates reference voltage based on external power supply voltage, the reference voltage generating circuit outputting the generated reference voltage from an output terminal thereof; a voltage generating circuit whose input terminal is connected to the output terminal of the reference voltage generating circuit, the voltage generating circuit lowering the external power supply voltage according to the reference voltage supplied from the reference voltage generating circuit to output internal power supply voltage from an output terminal thereof; and a transistor having a current path which is connected at one end to a terminal to which the external power supply voltage is supplied and connected at the other end to at least one of the output terminal of the voltage generating circuit and the output terminal of the reference voltage generating circuit, the transistor being supplied with constant voltage at a gate thereof and having negative threshold voltage.

A semiconductor device according to a fourth aspect of the invention comprises a reference voltage generating circuit having first and second output terminals, the reference voltage generating circuit generating reference voltage based on external voltage, outputting the generated reference voltage from the first output terminal, generating a control signal used to control a current source and outputting the thus generated control signal from the second output terminal; a voltage generating circuit whose input terminal is connected to the first output terminal of the reference voltage generating circuit, the voltage generating circuit lowering external power supply voltage according to the reference voltage supplied from the first output terminal of the reference voltage generating circuit to output internal power supply voltage from an output terminal thereof; a first transistor having a current path connected between a terminal to which the external power supply voltage is supplied and the output terminal of the voltage generating circuit and a gate supplied with first voltage and having negative threshold voltage; and a second transistor having a current path connected between a terminal to which the external power supply voltage is supplied and the second output terminal of the reference voltage generating circuit and having negative threshold voltage, a gate of the second transistor being grounded.

DETAILED DESCRIPTION OF THE INVENTION

There will now be described embodiments of this invention with reference to the accompanying drawings. In the respective embodiments, the same portions are denoted by the same reference symbols.

(First Embodiment)

Figure 1:
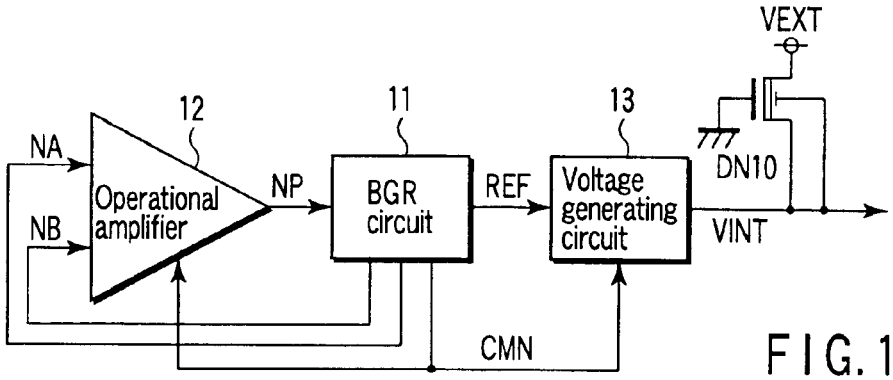
FIG. 1 is a configuration diagram showing a first embodiment.

FIG. 1 shows a first embodiment. A voltage lowering circuit shown in FIG. 1 includes a band gap reference (BGR) circuit 11 used as a reference voltage generating circuit which generates reference voltage, an operational amplifier (which is hereinafter referred to as an OP amplifier) 12, a voltage generating circuit 13 and a depletion type N-channel MOS transistor (which is hereinafter referred to as a D type NMOS transistor) DN10. Output signals NA, NB of the BGR circuit 11 are supplied to the OP amplifier 12 and an output signal NP of the OP amplifier 12 is supplied to the BGR circuit 11. A reference signal REF output from the BGR circuit 11 is supplied to the voltage generating circuit 13 and a signal CMN output from the BGR circuit 11 is supplied to the OP amplifier 12 and voltage generating circuit 13. The voltage generating circuit 13 outputs internal power supply voltage VINT in response to the reference signal REF. Further, the D type NMOS transistor DN10 is connected between the output terminal of the voltage generating circuit 13 and a terminal to which external power supply voltage VEXT is supplied. The gate of the transistor DN10 is grounded. Further, the substrate of the transistor DN10 is connected to the output terminal of the voltage generating circuit 13. The threshold voltage VTHN of the D type NMOS transistor DN10 is set at −1.4V, for example.

Figure 2:
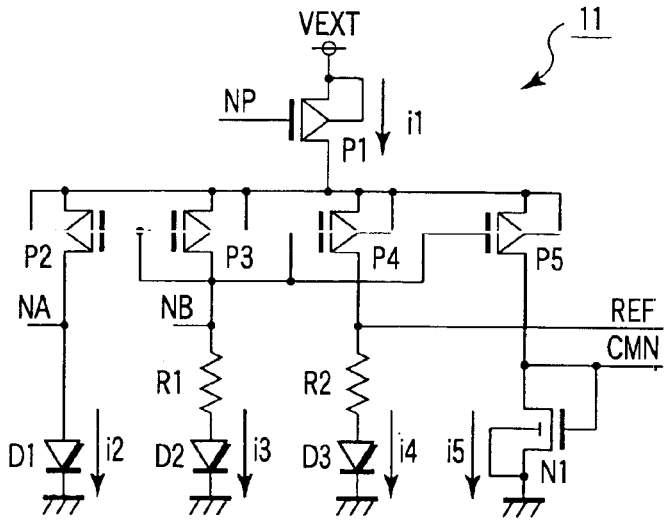
FIG. 2 is a circuit diagram showing one example of a BGR circuit shown in FIG. 1.
Figure 3:
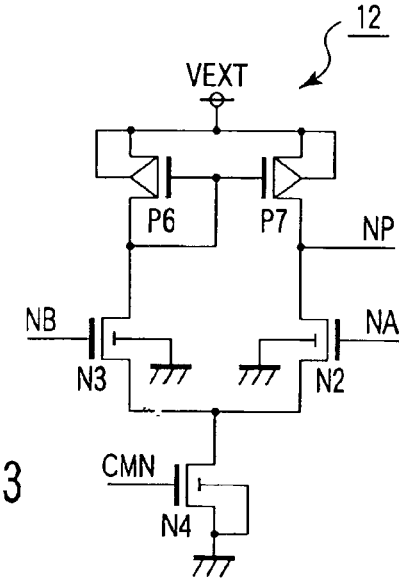
FIG. 3 is a circuit diagram showing one example of an operational amplifier shown in FIG. 1.
Figure 4:
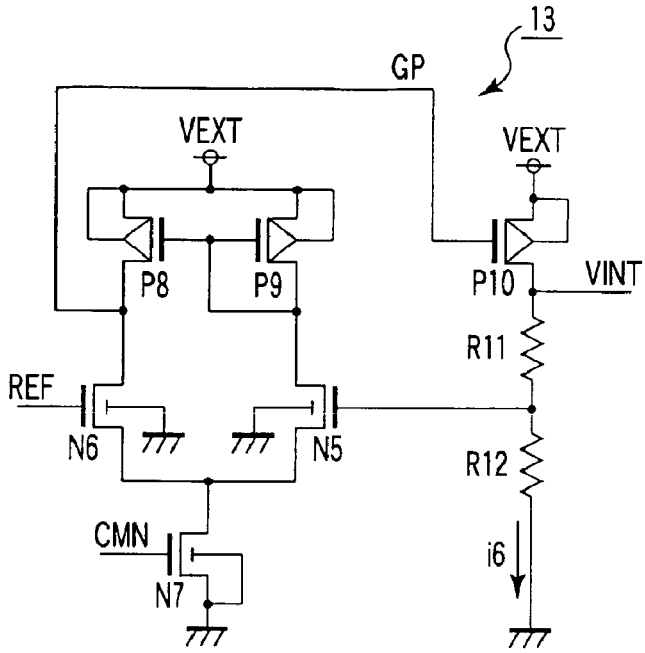
FIG. 4 is a circuit diagram showing one example of a voltage generating circuit shown in FIG. 1.

FIG. 2 shows one example of the BGR circuit 11, FIG. 3 shows one example of the OP amplifier 12, and FIG. 4 shows one example of the voltage generating circuit 13. It is assumed that the threshold voltages of PMOS transistors of the respective circuits are set to the same value and hereinafter referred to as VTHP. Further, the threshold voltages of NMOS transistors are referred to as VTHN.

In FIG. 2, the BGR circuit 11 includes PMOS transistors P1 to P5, NMOS transistor N1, diodes D1 to D3 and resistors R1, R2. An output signal NP of the OP amplifier 12 is supplied to the gate of the PMOS transistor P1. Further, the signal NA is output from a connection node of the PMOS transistor P2 and the diode D1 and the signal NB is output from a connection node of the PMOS transistor P3 and the resistor R1. The reference signal REF is output from a connection node of the PMOS transistor P4 and the resistor R2 and the signal CMN is output from a connection node of the PMOS transistor P5 and the NMOS transistor N1.

In FIG. 3, the OP amplifier 12 includes PMOS transistors P6, P7 and NMOS transistors N2, N3, N4. The signals NA, NB are respectively supplied to the gates of the NMOS transistors N2, N3 and the signal CMN is supplied to the gate of the NMOS transistor N4 used as a current source. A signal NP is output from a connection node of the PMOS transistor P7 and the NMOS transistor N2.

In FIG. 4, the voltage generating circuit 13 includes PMOS transistors P8, P9 configuring an OP amplifier, NMOS transistors N5, N6, N7 and a PMOS transistor P10 and resistors R11, R12 which configure a regulator. In the regulator, the PMOS transistor P10 and resistors R11, R12 are serially connected between a terminal to which the external power supply voltage VEXT is supplied and the ground node. A connection node of the resistors R11 and R12 is connected to the gate of the NMOS transistor N5 and the reference signal REF is supplied to the gate of the NMOS transistor N6. The signal CMN is supplied to the gate of the NMOS transistor N7 used as a current source. An output signal GP of the OP amplifier is supplied to the gate of the PMOS transistor P10 and internal power supply voltage VINT is output from a connection node of the PMOS transistor P10 and the resistor R11.

The operation of the voltage lowering circuit is explained with reference to FIG. 5. In this case, it is assumed that the voltage level of the signal NA is VNA, the voltage level of the signal NB is VNB, the voltage level of the reference signal REF is VREF, and the voltage level of the signal CMN is VCMN.

Figure 5:
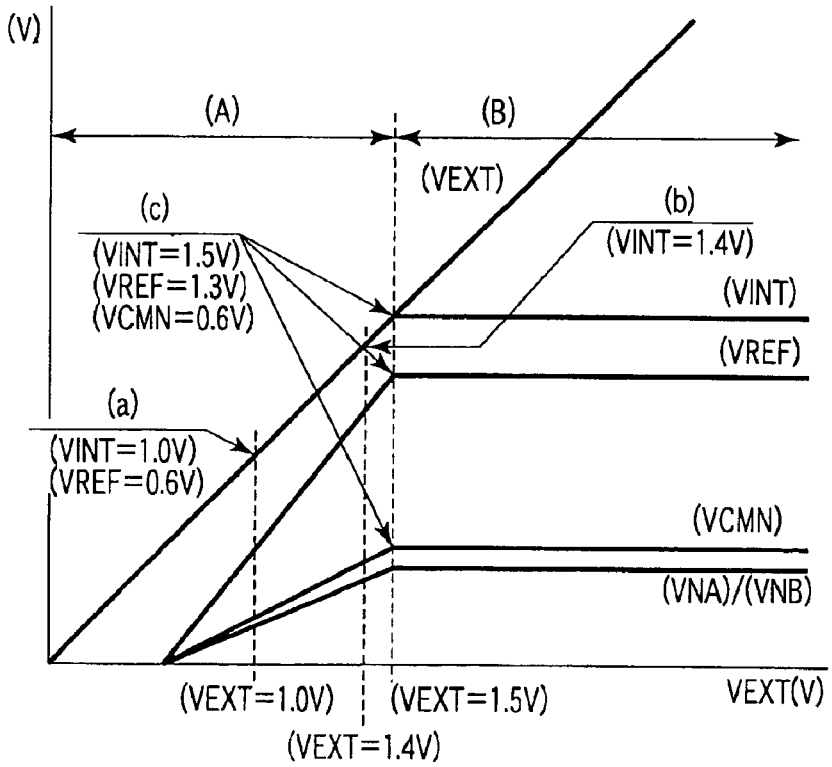
FIG. 5 is a characteristic diagram showing the operation of the circuit shown in FIG. 1.

First, a case wherein the voltage of VEXT lies within a range (B) shown in FIG. 5 is explained. In the range (B), VEXT is set equal to or higher than 1.5V and the normal operation is performed. As shown in FIG. 1, the OP amplifier shown in FIG. 3 and the BGR circuit shown in FIG. 2 configure a loop circuit in which the output signals of the circuits are respectively input to the other circuits. The output signals NA, NB of the BGR circuit 11 are so set that the relation of VNA=VNB can be attained because of the characteristic of the BGR circuit 11. That is, the PMOS transistors P2 and P3 configure a current mirror circuit and currents i2, i3 flowing in the diodes D1, D2 become equal to each other. Therefore, the relation of VNA=VNB can be attained.

Figure 6A:
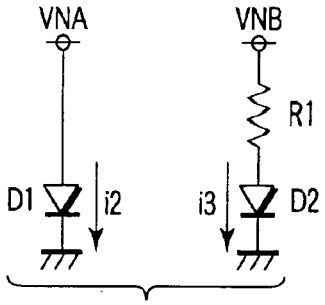
FIG. 6A is a diagram showing currents i2, i3 flowing in diodes D1, D2.
Figure 6B:
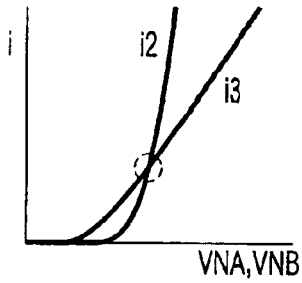
FIG. 6B is a characteristic diagram showing the voltage-current characteristics of the diodes D1, D2.

FIGS. 6A and 6B show the currents i2, i3 flowing in the diodes D1, D2 and the relation between the voltage-current characteristics of the voltages VNA, VNB. The voltage-current characteristic of the voltage VNA and current i2 and the voltage-current characteristic of the voltage VNB and current i3 are obtained as shown in FIG. 6B. Thus, the state is inevitably stabilized at VNA=VNB when the currents i2 and i3 are equal to each other. When the signals NA, NB in the above voltage state are supplied to the OP amplifier 12, the voltage of the output signal NP of the OP amplifier 12 becomes substantially equal to (VEXT−|VTHP|). If the output signal NP of the OP amplifier 12 is supplied to the gate of the PMOS transistor P1 of the BGR circuit 11, (|VGS|−|VTHP|) of the PMOS transistor P1 is set to a constant value. As a result, the current i1 flowing in the PMOS transistor P1 becomes constant irrespective of a rise in the voltage VEXT. The current i1 is divided into currents i2 to i5 and flows. However, since the current i1 becomes constant irrespective of a rise in VEXT, the currents i2 to i5 will not depend on a rise in VEXT and become constant. The voltage VNA of the output signal NA of the BGR circuit 11 is determined by the following equation.

$$VNA=i2\times DR1$$

where DR1 denotes the resistance of the diode D1.

Further, the voltage VNB of the output signal NB is determined by the following equation.

$$VNB=i3\times(DR2+R1)$$

where DR2 denotes the resistance of the diode D2.

Also, the voltage VREF of the reference signal REF is determined by the following equation.

$$VREF=i4\times(DR3+R2)$$

where DR3 denotes the resistance of the diode D3.

Further, the voltage VCMN of the signal CMN is determined by the following equation.

$$VCMN=i5\times NR1$$

where NR1 denotes the channel resistance of the NMOS transistor N1.

Since the currents i2 to i5 become constant as described before, the voltages of the signals NA, NB, REF, CMN also become constant. In addition, as shown in FIG. 1, the BGR circuit 11 and OP amplifier 12 configure the loop circuit and the voltages of the signals NA, NB, REF, CMN, NP are stabilized in a balanced state. The signals CMN, REF are supplied to the voltage generating circuit 13 shown in FIG. 4 and VINT is output from the voltage generating circuit 13. The voltage of VINT is expressed by the following equation (1).

$$VINT=(VREF\times(R11+R12)/R12) \quad (1)$$

Alternatively, it can be expressed by the following equation.

$$VINT=i6\times(R11+R12)$$

The current i6 flows through the PMOS transistor P10 having a gate to which a signal GP output from the OP amplifier of the voltage generating circuit 13 is supplied. Since the reference signal is set at a constant value as described before, the voltage of VINT becomes constant as is expressed in the equation (1). When the voltage VINT derived from the equation (1) is higher than the voltage VEXT, VINT becomes equal to VEXT.

At this time, the operation of the D type NMOS transistor DN10 is performed as follows.

As described before, the threshold voltage VTHN of the MOS transistor DN10 is set at −1.4V. The MOS transistor DN10 is set into the ON state in a condition of Vgs (gate-source voltage)≧VTHN and set into the OFF state in a condition of Vgs<VTH=−1.4V. Therefore, the NMOS transistor DN10 is set into the OFF state in a range (VINT=1.4V) higher than the level (b) shown in FIG. 5 since the condition of Vgs<VTH=−1.4V is set up. Thus, when VEXT is set in a steady state, VINT is set to voltage determined by the equation (1) and becomes constant in the range (B).

Next, a case wherein the voltage of VEXT lies in a range (A) shown in FIG. 5, for example, in the standby mode is explained. Unlike the case of the range (B), in the range (A), the voltages of the signals NA, NB, REF, CMN are set at low voltages. That is, when VEXT is low, the current drive ability of the transistor in each of the circuits is small and each circuit cannot perform the steady-state operation. Therefore, the voltage of each signal becomes lower than in the case of the range (B). In this state, each of the currents i1 to i5 becomes larger with an increase in VEXT. Therefore, the voltages of the signals NA, NB, REF, CMN become higher with an increase in VEXT. Then, when VEXT reaches the range (B), each circuit comes to perform the steady-state operation. In the state of the range (A), VINT is set to voltage expressed by the equation (1).

The NMOS transistor DN10 maintains the ON state when the source voltage is set in the range of VINT=0V to 1.4V. Therefore, as shown in FIG. 5, VINT is set equal to VEXT irrespective of VREF in a range of VEXT=0V to 1.4V (up to (b) in FIG. 5).

The approximate values of the voltages of VINT, VREF, VCMN with respect to VEXT in the voltage lowering circuit shown in FIGS. 1 to 4 are set as shown by (a), (b), (c) of FIG. 5. The approximate values of the steady-state voltages of the respective signals in the range (B) in which VEXT is higher than 1.5V are so set that VINT=1.5V, VREF=1.3V and VCMN=0.6V. Further, the approximate ratio R11:R12 of the resistances of the resistors R11 and R12 of the voltage generating circuit 13 shown in FIG. 4 is set to 1:6. That is, when R11=1 kΩ, R12=6 kΩ. If VINT is derived as follows by substituting the above values into the equation (1), VINT becomes approximately equal to 1.5V.

$$VINT=(1.3)\times(1k+6k)/6k)=1.517V$$

According to the first embodiment, the D type NMOS transistor DN10 is provided between the output terminal of the voltage generating circuit 13 and the VEXT terminal. Therefore, VINT is set to a higher one of the voltage caused by the D type NMOS transistor DN10 and the voltage caused by the BGR circuit 11. Thus, the voltage of VINT is obtained as shown in FIG. 5 and VINT which is equal to VEXT is output from the state where the voltage of VEXT is low in the range (A). As a result, when VEXT is 1V as shown by (a) of FIG. 5, VINT becomes equal to 1V. Therefore, for example, when the semiconductor device is set in the standby mode, VINT can be suppressed from becoming lower than VEXT in a state in which VEXT is low. Thus, the performance of the semiconductor device in the state in which VEXT is low can be enhanced. Particularly, when the voltage lowering circuit is applied to a static RAM, the data retention of the memory can be prevented from being lowered.

Further, the gate of the D type NMOS transistor DN10 is grounded and the NMOS transistor DN10 is controlled by VEXT and VINT. Therefore, since a control signal is not additionally required in order to control the operation of the NMOS transistor DN10, it is not necessary to provide a circuit which generates the above control signal.

Further, a control signal is not additionally required in order to control the operation of the NMOS transistor DN10. Therefore, the internal power supply voltage can be maintained at the same level as the external power supply voltage when the external power supply voltage is lower than in the steady-state time in a case wherein the semiconductor device is set in any operation state. For example, the above operation can be attained not only in a case wherein the semiconductor device is set in the standby mode, but also in a period from the time the power supply is changed from the turn-OFF state into the turn-ON state until the external power supply voltage reaches a preset value.

When the semiconductor device is released from the standby state and set into the active mode, the NMOS transistor DN10 is turned OFF in response to VINT output from the voltage generating circuit 13 without performing any control operation. Therefore, stable VINT output from the voltage generating circuit 13 can be instantaneously output.

(Second Embodiment)

Figure 7:
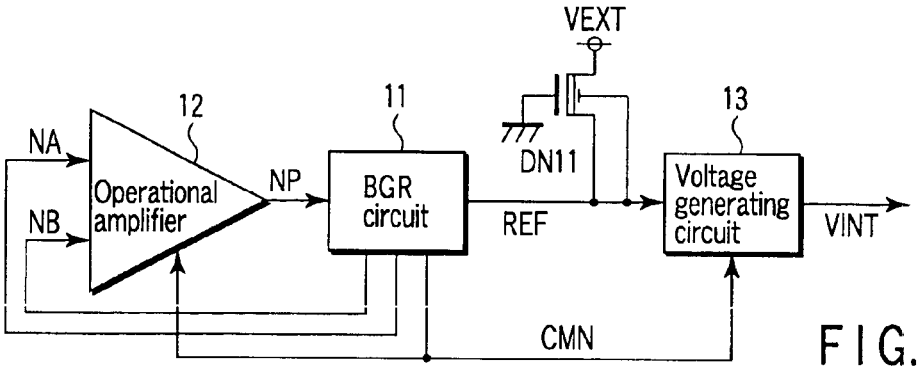
FIG. 7 is a configuration diagram showing a second embodiment.

FIG. 7 shows a second embodiment. In the first embodiment, the D type NMOS transistor DN10 is connected to the output terminal of the voltage generating circuit 13. On the other hand, in the second embodiment, the current path of a D type NMOS transistor DN11 is connected between the output terminal of a BGR circuit 11 from which a reference signal REF is output and a terminal to which VEXT is supplied. The gate of the NMOS transistor DN11 is grounded and the substrate is connected to the output terminal from which the reference signal REF is output. The threshold voltage VTHN of the transistor DN11 is set at −1.2V, for example.

Figure 8:
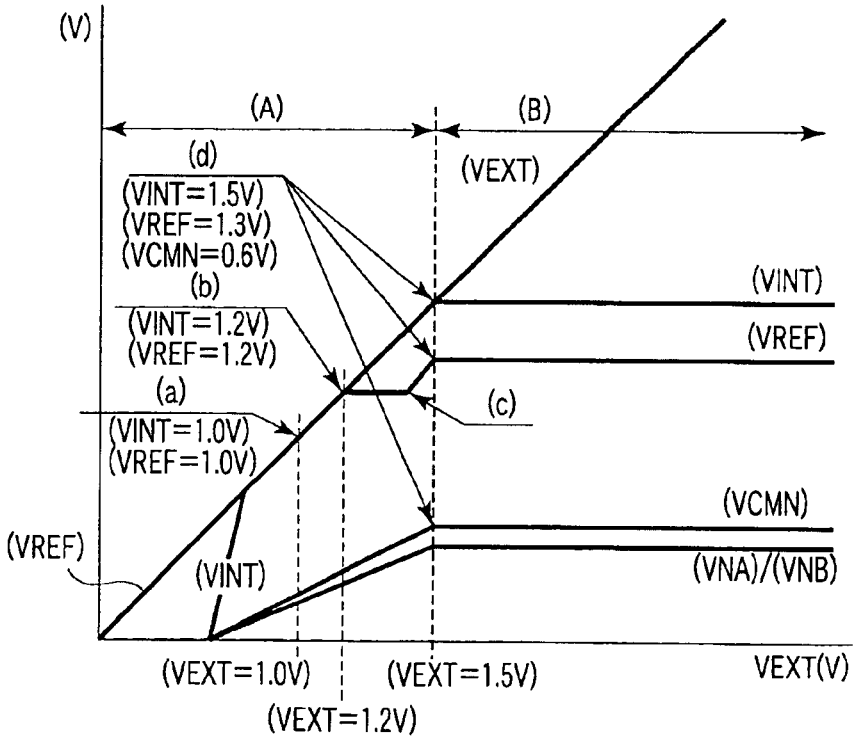
FIG. 8 is a characteristic diagram showing the operation of the circuit shown in FIG. 7.

FIG. 8 shows the operation of the circuit shown in FIG. 7. The D type NMOS transistor DN11 is set in the ON state in a condition of Vgs>VTHN. The source of the transistor DN11 maintains the ON state when the voltage VREF of the signal REF is set in a range of 0V to 1.2V. That is, as shown in FIG. 8, VREF becomes equal to VEXT in a range of VEXT=0V to 1.2V (in a range up to (b) of FIG. 8). When VEXT is set in a range of (b) to (c), the transistor DN11 is set in the ON state and therefore VREF is kept at 1.2V according to VEXT. Further, in a range of VEXT higher than (c), a condition of Vgs<VTH=−1.2V is set up and the transistor DN11 is set into the OFF state. Therefore, VREF is set to a voltage value output from the BGR circuit 11 and VEXT is set to a constant voltage value in a range (B) which is higher than (d).

According to the second embodiment, the D type NMOS transistor DN11 is provided at the output terminal of the BGR circuit 11. Therefore, VREF is set to a higher one of the voltage output from the transistor DN11 and the output voltage of the BGR circuit 11. Thus, VREF and VINT are set to voltages as shown in FIG. 8 and the voltages of VINT and VEXT can be set equal to each other in a state in which VEXT is set low as shown in the range (A). As a result, at a time point of VEXT=1V, VINT=1V can be output. Therefore, in the second embodiment, the same effect as that of the first embodiment can be attained.

(Third Embodiment)

Figure 9:
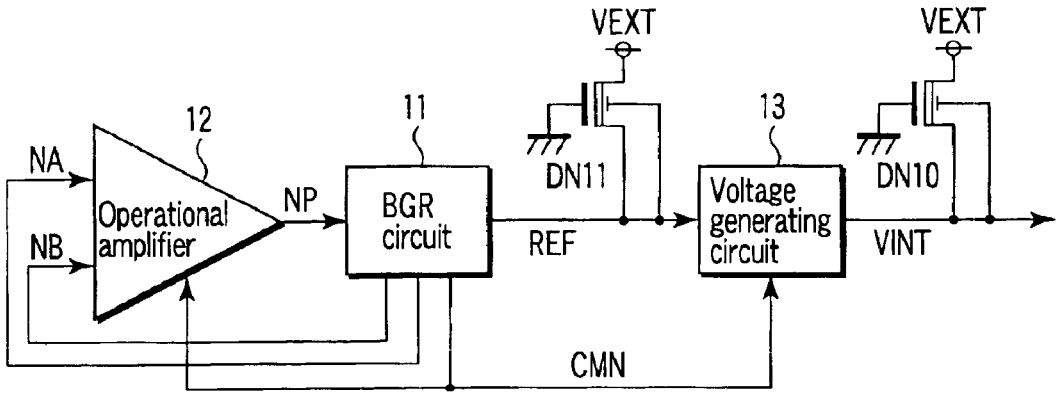
FIG. 9 is a configuration diagram showing a third embodiment.
Figure 10:
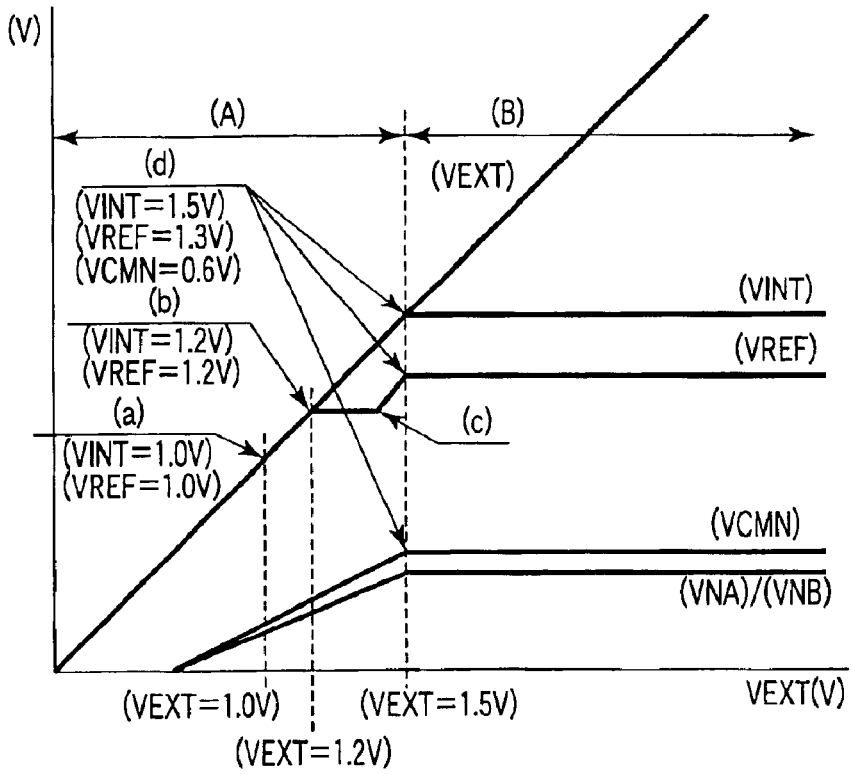
FIG. 10 is a characteristic diagram showing the operation of the circuit shown in FIG. 9.

FIG. 9 shows a third embodiment. The third embodiment shown in FIG. 9 relates to a circuit configuration obtained by combining the first embodiment shown in FIG. 1 and the second embodiment shown in FIG. 7. FIG. 10 is an operation characteristic diagram of the circuit shown in FIG. 9. FIG. 10 is an operation characteristic diagram in a case wherein the threshold voltages VTHN of D type NMOS transistors DN11, DN10 are both set at −1.2V. The characteristic diagram of the voltages of signals shown in FIG. 10 is obtained by combining the characteristic diagram of FIG. 5 and the characteristic diagram of FIG. 8 and the characteristic diagram shows a higher one of the voltage of FIG. 5 and the voltage of FIG. 8.

Like the first and second embodiments, in the range (A) of FIG. 10, VINT is output together with VEXT in a state in which the voltage of VEXT is low. That is, when VEXT is 1V as shown by (a), VINT=1V is output, for example.

FIG. 10 is an operation characteristic diagram in a case wherein the threshold voltage VTHN of the D type NMOS transistor DN10 is set to correspond to the threshold voltage VTHN=−1.2V of the D type NMOS transistor DN11. However, the threshold voltages VTHN of the D type NMOS transistors DN11 and DN10 can be set to different threshold voltages, for example, VTHN=−1.2V, VTHN=−1.4V, respectively. Also, in this case, the characteristic equivalent to the operation characteristic shown in FIG. 10 can be attained.

According to the third embodiment, the same effect as that of the first and second embodiments can be attained.

(Fourth Embodiment)

Figure 11:
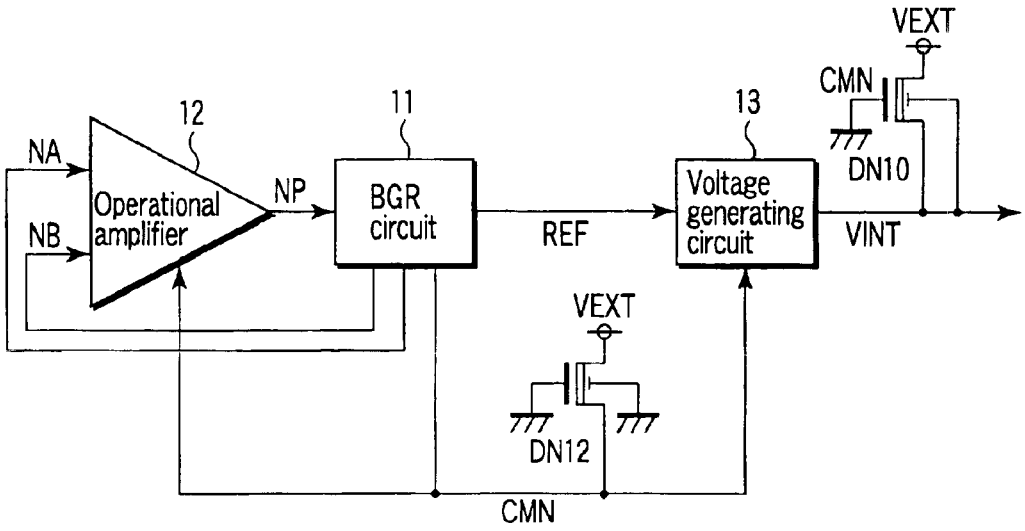
FIG. 11 is a configuration diagram showing a fourth embodiment.

FIG. 11 shows a fourth embodiment. In FIG. 11, a D type NMOS transistor DN10 is connected between the output terminal of a voltage generating circuit 13 and a terminal to which VEXT is supplied. The gate of the NMOS transistor DN10 is supplied with a signal CMN output from a BGR circuit 11 and the substrate thereof is connected to the output terminal of the voltage generating circuit 13. Further, a D type NMOS transistor DN12 is connected between an output terminal of the BGR circuit 11 from which the signal CMN is output and the terminal to which VEXT is supplied. The gate and substrate of the NMOS transistor DN12 are grounded, for example.

The substrate voltage (VB) of the NMOS transistor DN12 is set at ground potential. Therefore, the threshold voltage VTHN of the NMOS transistor DN12 becomes higher because of the back-gate bias effect as the source voltage VCMN of the NMOS transistor DN12 rises. That is, the threshold voltage VTHN becomes higher as the voltage VBS between the substrate and the source of the NMOS transistor DN12 becomes more negative. For example, in a case where VTHN obtained when VBS of the NMOS transistor DN10 is set at 0V is set at −0.7V, VBS of the NMOS transistor DN12 is set at −0.5V when the source voltage VCMN of the NMOS transistor DN12 is set equal to 0.5V. As a result, VTHN is set to approximately −0.5V. That is, VTHN of the NMOS transistor DN12 becomes higher than VTHN of the NMOS transistor DN10 by 0.2V.

Figure 12:
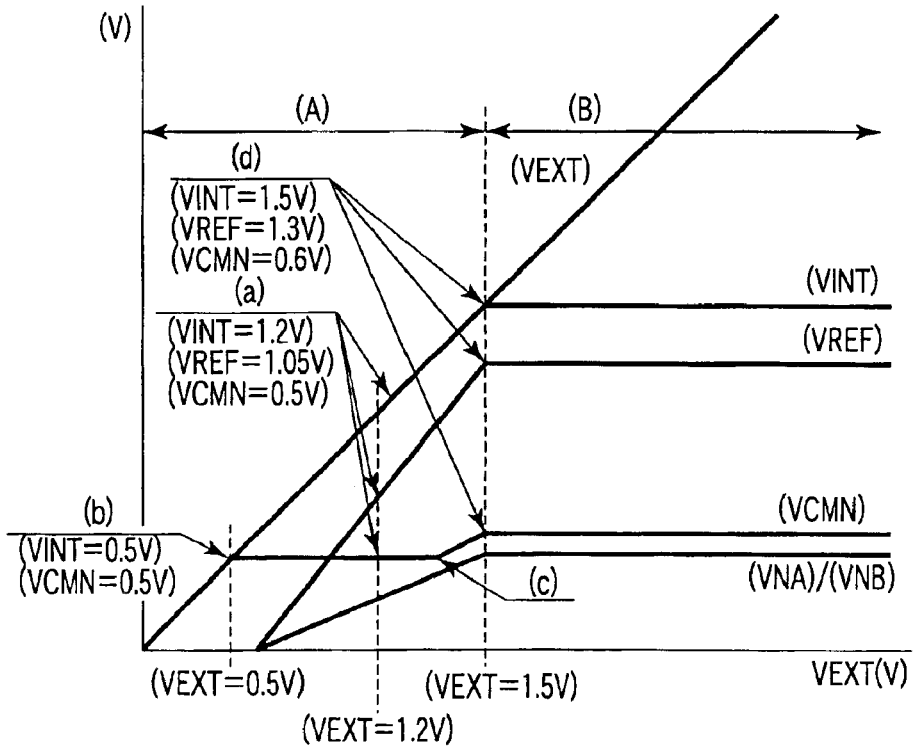
FIG. 12 is a characteristic diagram showing the operation of the circuit shown in FIG. 11.

FIG. 12 is an operation characteristic diagram of the circuit shown in FIG. 11 in a case where VTHN obtained when VBS of the NMOS transistor DN12 is set at 0.5V is set at −0.5V, and at this time, VTHN obtained when VBS of the NMOS transistor DN10 is set at 0V is set at −0.7V by utilizing the relation of the above threshold voltages.

The NMOS transistor DN12 is set into the ON state in a condition of Vgs>VTHN. Therefore, the NMOS transistor DN12 maintains the ON state while the source voltage VCMN thereof is kept in the range of 0V to 0.5V. Thus, as shown in FIG. 12, VCMN is set equal to VEXT when VEXT is set between 0V and 0.5V (in a range of VEXT=0V to (b)). Further, in a range of (b) to (c), VCMN maintains 0.5V by the action of the NMOS transistor DN12. In a range higher than (c), the condition of Vgs<VTHN=−0.5V is set for the NMOS, transistor DN12. Therefore, since the NMOS transistor DN12 is set into the OFF state, VCMN is set to voltage output from the BGR circuit 11 and is set to constant voltage in a range (B) higher than (d).

Further, the gate of the NMOS transistor DN10 is supplied with the signal CMN and VTHN is set at −0.7V. The NMOS transistor DN10 is set in the ON state in a condition of Vgs≧VTHN. Therefore, the NMOS transistor DN10 maintains the ON state when voltage VINT supplied to the source of the NMOS transistor DN10 is set in the range of 0V to 1.2V in a state in which VCMN is set at 0.5V. Thus, as shown in FIG. 12, VINT is set equal to VEXT irrespective of VREF while VEXT is set between 0V and 1.2V (in a range of VEXT=0V to (a)).

Further, in (a) shown in FIG. 12, VREF=1.05V is output from the BGR circuit 11. Therefore, the output voltage VINT of the voltage generating circuit 13 is set to voltage=1.2V which is determined by the equation (1). On the other hand, in a range higher than (a), since a condition of Vgs<VTH=−0.7V is set up, the NMOS transistor DN10 is set into the OFF state. Therefore, VINT is set to voltage determined by the equation (1). Further, in a range (B) higher than (d), VINT is set to constant voltage.

As described above, since the NMOS transistor DN10 is connected to the output terminal of the voltage generating circuit 13, VINT is set to a higher one of the voltage obtained by the NMOS transistor DN10 and the voltage obtained by the BGR circuit 11. Therefore, VINT is set to voltage as shown in FIG. 12 and VINT of voltage equal to VEXT in a state in which the voltage of VEXT is low is output in the range (A). That is, when VEXT is set at 1V, a voltage of 1V is output as VINT.

Figure 13:
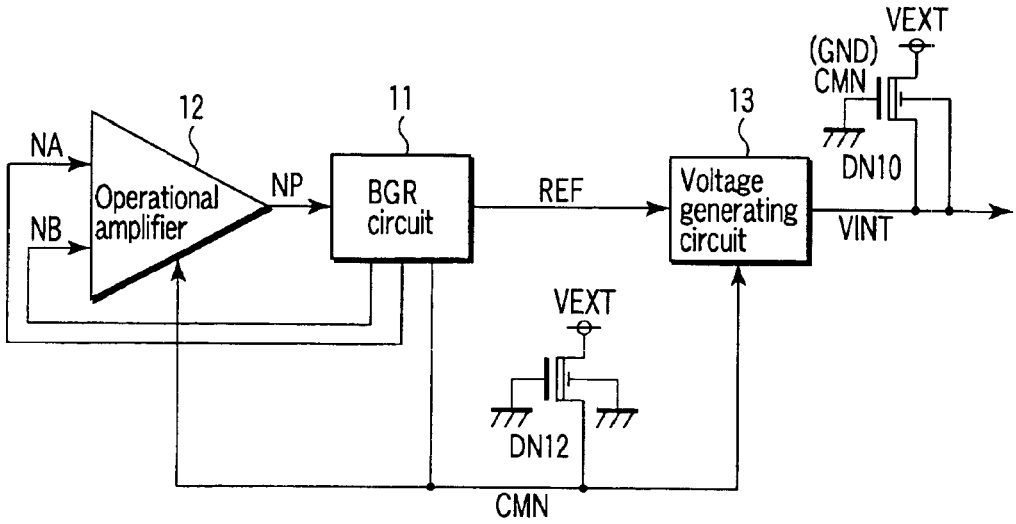
FIG. 13 is a configuration diagram showing a modification of FIG. 11.

The operation characteristic diagram of FIG. 12 shows a case wherein the voltages VTHN of the NMOS transistors DN10, DN12 are set equal to each other when VBS is set at 0V and the relation between the voltages VTHN of the NMOS transistors DN10, DN12 is set to the relation of VTHN(DN10)<VTHN(DN12) when VEXT is set at 0V or more by utilizing the back-gate effect of the NMOS transistor DN12. However, this is not limitative. FIG. 13 shows a modification of FIG. 11. As shown in FIG. 13, the substrate of the NMOS transistor DN12 is connected to an output terminal of the signal CMN. With this configuration, like the NMOS transistor DN10, VBS of the NMOS transistor DN12 is set at 0V. Therefore, the voltages VTHN of the NMOS transistors DN10 and DN12 are respectively set at −0.5V and −0.7V.

Further, as shown in FIG. 13, the gate voltage of the NMOS transistor DN10 is not limited to the signal CMN and can be set to ground potential.

With the above configuration, the characteristic substantially equivalent to the operation characteristic shown in FIG. 12 can be attained.

(Fifth Embodiment)

Figure 14:
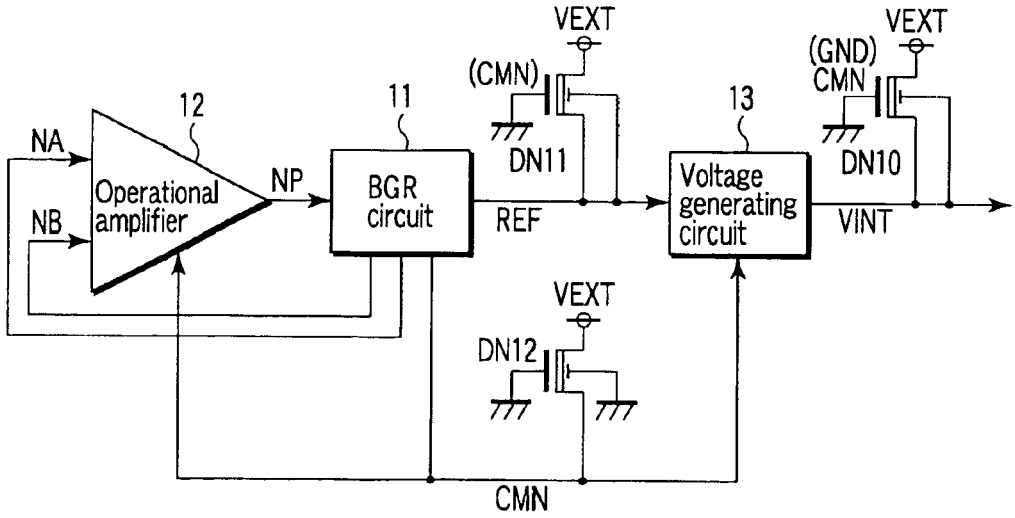
FIG. 14 is a configuration diagram showing a fifth embodiment.

FIG. 14 shows a fifth embodiment. The fifth embodiment shows an example obtained by combining the embodiments shown in FIGS. 7 and 11. That is, a D type NMOS transistor DN11 is connected between an output terminal of a BGR circuit 11 from which a reference signal REF is output and a terminal to which VEXT is supplied. The gate of the NMOS transistor DN11 is grounded and the substrate thereof is connected to the output terminal from which the reference signal REF is output. A D type NMOS transistor DN12 is connected between an output terminal of the BGR circuit 11 from which a signal CMN is output and the terminal to which VEXT is supplied. The gate and substrate of the NMOS transistor DN12 are grounded. A D type NMOS transistor DN10 is connected between an output terminal of a voltage generating circuit 13 and the terminal to which VEXT is supplied. The gate of the NMOS transistor DN10 is supplied with the signal CMN and the substrate thereof is connected to the output terminal of the voltage generating circuit 13.

With the above configuration, when VEXT is equal to or higher than 0V, VTHN of the NMOS transistor DN12 rises by the back-gate effect. Since VBS of each of the NMOS transistors DN11, DN10 is set at 0V, no back-gate effect occurs. Therefore, the relation of the voltages VTHN of the NMOS transistors DN11, DN10, DN12 when VEXT is equal to or higher than 0V is so set that the relation of VTHN (DN10)=VTHN(DN11)<VTHN(DN12) can be attained.

Further, the relation of the gate voltages Vg of the NMOS transistors DN11, DN10, DN12 is so set that the relation of Vg(DN11)=Vg(DN12)<Vg(DN10) can be attained. Therefore, the NMOS transistors DN12, DN11, DN10 are turned OFF in this order when VEXT rises. As a result, a characteristic in which VINT=1V is output at the time of VEXT=1V can be attained without independently setting the voltages VTHN of the NMOS transistors DN11, DN10, DN12.

In FIG. 14, the gate voltage of the NMOS transistor DN11 is not limited to the ground potential and can be set at the potential of the signal CMN. Also, the gate voltage of the NMOS transistor DN10 is not limited to the potential of the signal CMN and can be set at the ground potential.

Figure 15:
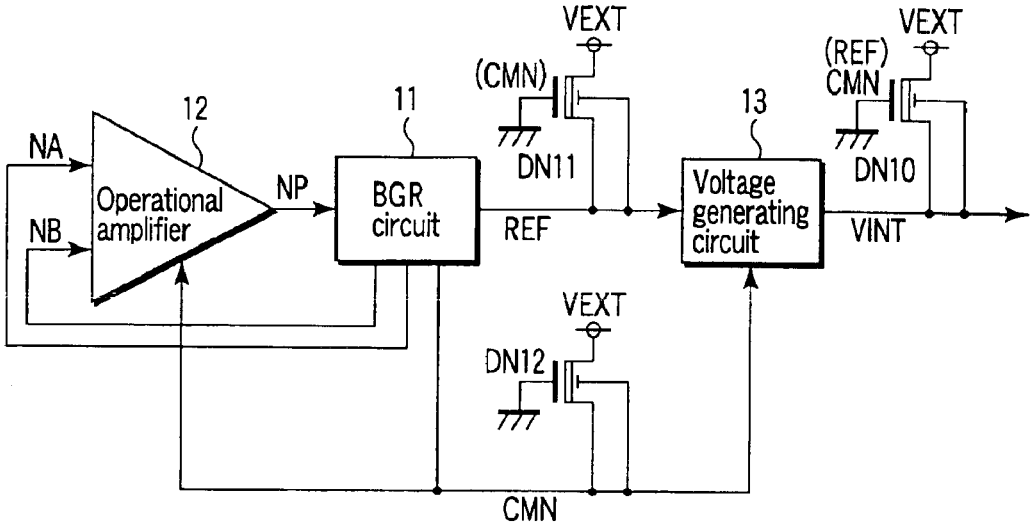
FIG. 15 is a configuration diagram showing a modification of the circuit shown in FIG. 14.

FIG. 15 shows a modification of the circuit shown iii FIG. 14. The substrate of the NMOS transistor DN12 is connected to the output terminal from which the signal CMN is output. Thus, VINT=1V can be output at the time of VEXT=1V if the voltages VTHN of the NMOS transistors DN11, DN10, DN12 are independently set.

In each of the above embodiments, the voltages supplies to the drains of the NMOS transistors DN10, DN11, DN12 are set at VEXT. However, this is not limitative. For example, power supply voltage which varies with voltage equivalent to VEXT in a period from turn-ON of the power supply until it reaches 1V or signal voltage in the semiconductor device output at voltage equivalent to VEXT in a period from turn-ON of the power supply until it reaches 1V can be supplied to the drains of the NMOS transistors DN10, DN11, DN12.

Further, in each of the above embodiments, the reference signal REF is generated by use of the BGR circuit 11 and OP amplifier 12. However, this is not limitative.

Figure 16:
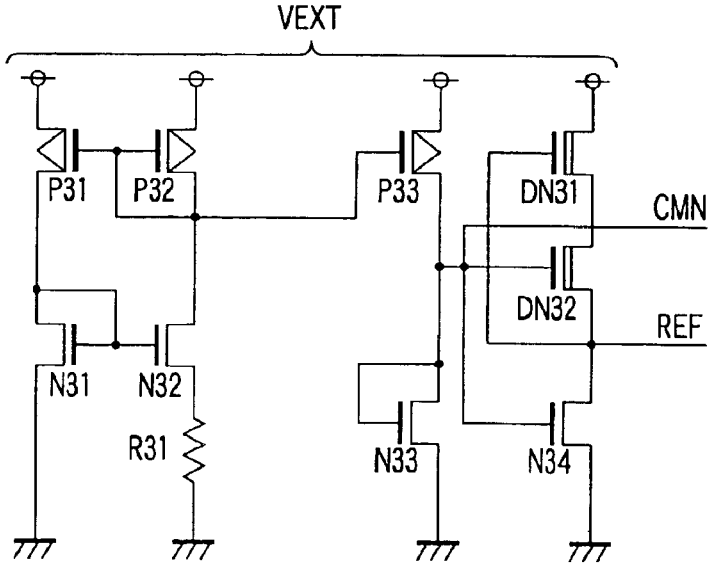
FIG. 16 is a circuit diagram showing a modification of a reference signal REF generating circuit.

FIG. 16 is a circuit diagram showing a modification of the reference signal REF generating circuit. The circuit includes a current mirror circuit and voltage generating circuit. The current mirror circuit includes PMOS transistors P31, P32, NMOS transistors N31, N32 and resistor R31. The voltage generating circuit includes a PMOS transistor P33, NMOS transistors N33, N34, and D type NMOS transistors DN31, DN32. The signal REF is output from a connection node of the D type NMOS transistor DN32 and the NMOS transistor N34 and the signal CMN is output from a connection node of the PMOS transistor P33 and the NMOS transistor N33. The same effect as that of each of the above embodiments can be attained by use of the generator circuit.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A semiconductor device comprising:

a reference voltage generating circuit which generates reference voltage based on external power supply voltage, the reference voltage generating circuit outputting the generated reference voltage from an output terminal thereof;

a voltage generating circuit whose input terminal is connected to the output terminal of the reference voltage generating circuit, the voltage generating circuit lowering the external power supply voltage according to the reference voltage supplied from the reference voltage generating circuit to output internal power supply voltage from an output terminal thereof; and at least one of first and second transistors provided in the semiconductor device, the first transistor having a current path connected between a terminal to which the external power supply voltage is supplied and the output terminal of the voltage generating circuit and a gate supplied with constant voltage and having negative threshold voltage and the second transistor having a current path connected between a terminal to which the external power supply voltage is supplied and the output terminal of the reference voltage generating circuit and a gate supplied with constant voltage and having negative threshold voltage.

2. The device according to claim 1, wherein the gate of the first transistor is connected to one of a ground node and the output terminal of the reference voltage generating circuit and the substrate thereof is connected to the output terminal of the voltage generating circuit.

3. The device according to claim 1, wherein the gate of the second transistor is grounded and the substrate thereof is connected to the output terminal of the reference voltage generating circuit.

4. A semiconductor device comprising:

a reference voltage generating circuit having first and second output terminals, the reference voltage generating circuit generating reference voltage based on an external voltage, outputting the thus generated reference voltage from the first output terminal, generating a control signal used to control a current source and outputting the thus generated control signal from the second output terminal;

a voltage generating circuit whose input terminal is connected to the first output terminal of the reference voltage generating circuit, the voltage generating circuit lowering external power supply voltage according to the reference voltage supplied from the first output terminal of the reference voltage generating circuit to output internal power supply voltage from an output terminal thereof;

a first transistor having a current path connected between a terminal to which the external power supply voltage is supplied and the output terminal of the voltage generating circuit and a gate supplied with first voltage and having negative threshold voltage; and at least one of second and third transistors provided in the semiconductor device, the second transistor having a current path connected between a terminal to which the external power supply voltage is supplied and the first output terminal of the reference voltage generating circuit and a gate supplied with second voltage and having negative threshold voltage and the third transistor having a current path connected between a terminal to which the external power supply voltage is supplied and the second output terminal of the reference voltage generating circuit and a gate supplied with preset voltage and having negative threshold voltage.

5. The device according to claim 4, wherein the first voltage is one of the reference voltage, voltage of the control signal and ground voltage.

6. The device according to claim 4, wherein the substrate of the first transistor is connected to the output terminal of the voltage generating circuit.

7. The device according to claim 4, wherein the second voltage is one of the ground voltage and the voltage of the control signal.

8. The device according to claim 4, wherein the substrate of the second transistor is connected to the first output terminal of the reference voltage generating circuit.

9. The device according to claim 4, wherein the gate of the third transistor is grounded and the substrate thereof is connected to one of the second output terminal of the reference voltage generating circuit and the ground node.

10. The device according to claim 4, wherein each of the first to third transistors is configured by an N-channel transistor.

11. The device according to claim 4, wherein the reference voltage generating circuit includes a fourth transistor of a P-channel type having a current path connected at one end to a terminal to which the external power supply voltage is supplied; a fifth transistor of the P-channel type having a current path connected at one end to the other end of the current path of the fourth transistor; sixth, seventh and eighth transistors of the P-channel type having current paths connected at one-side ends to the other end of the current path of the fourth transistor, the sixth, seventh and eighth transistors being combined with the fifth transistor to configure a current mirror circuit; a first resistor and first diode serially connected between the other end of the current path of the fifth transistor and the ground node; a second diode connected between the other end of the current path of the sixth transistor and the ground node; a second resistor and third diode serially connected between the other end of the current path of the seventh transistor and the ground node, the other end of the current path of the seventh transistor being used as the first output terminal; a ninth transistor of an N-channel type connected between the other end of the current path of the eighth transistor and the ground node, the gate of the ninth transistor being connected to the other end of the current path of the eighth transistor and the other end of the current path of the eighth transistor being used as the second output terminal; and a first operational amplifier having first and second input terminals and a first output terminal, the first and second input terminals of the first operational amplifier being connected to the other ends of the current paths of the sixth and fifth transistors and the first output terminal thereof being connected to the gate of the fourth transistor.

12. The device according to claim 11, wherein the first operational amplifier includes tenth and eleventh transistors of the P-channel type having current paths connected at one-side ends to the terminal to which the external power supply voltage is supplied, the gates of the tenth and eleventh transistors being connected together; twelfth and thirteenth transistors of the N-channel type having current paths respectively connected at one-side ends to the other ends of the current paths of the tenth and eleventh transistors, one end of the current path of the twelfth transistor being connected to the gate of the ninth transistor, the gate of the twelfth transistor being used as the first input terminal, the gate of the thirteenth transistor being used as the second input terminal, and one end of the current path of the thirteenth transistor being used as the first output terminal of the first operational amplifier; and a fourteenth transistor of the N-channel type having a current path connected between the other ends of the twelfth and thirteenth transistors and the ground node, the gate of the fourteenth transistor being connected to the second output terminal of the reference voltage generating circuit.

13. The device according to claim 11, wherein the voltage generating circuit includes a second operational amplifier; and a regulator circuit connected to the second operational amplifier;

the second operational amplifier including fifteenth and sixteenth transistors of the P-channel type having current paths connected at one-side ends to the terminal to which the external power supply voltage is supplied, the gates of the fifteenth and sixteenth transistors being connected together; seventeenth and eighteenth transistors of the N-channel type having current paths respectively connected at one-side ends to the other ends of the current paths of the fifteenth and sixteenth transistors, one end of the current path of the eighteenth transistor being connected to the gate of the fifteenth transistor, and the gate of the seventeenth transistor being connected to the first output terminal of the reference voltage generating circuit; and a nineteenth transistor of the N-channel type having a current path connected between the other ends of the seventeenth and eighteenth transistors and the ground node, the gate of the nineteenth transistor being connected to the second output terminal of the reference voltage generating circuit; and the regulator circuit including a twentieth transistor of the P-channel type having a current path connected at one end to the terminal to which the external power supply voltage is supplied, the gate of the twentieth transistor being connected to one end of the current path of the seventeenth transistor; and third and fourth resistors serially connected between the twentieth transistor and the ground node, a connection node of the third and fourth resistors being connected to the gate of the eighteenth transistor and the internal power supply voltage being output from a connection node of the twentieth transistor and the third resistor.

14. A semiconductor device comprising:

a reference voltage generating circuit which generates reference voltage based on external power supply voltage, the reference voltage generating circuit outputting the generated reference voltage from an output terminal thereof;

a voltage generating circuit whose input terminal is connected to the output terminal of the reference voltage generating circuit, the voltage generating circuit lowering the external power supply voltage according to the reference voltage supplied from the reference voltage generating circuit to output internal power supply voltage from an output terminal thereof; and a transistor having a current path connected at one end to a terminal to which the external power supply voltage is supplied and connected at the other end to one of the output terminal of the voltage generating circuit and the output terminal of the reference voltage generating circuit, the transistor being supplied with constant voltage at a gate thereof and having negative threshold voltage.

15. The device according to claim 14, wherein the gate of the transistor is grounded and the substrate thereof is set at the same potential as the other end of the current path of the transistor.

16. A semiconductor device comprising:

a reference voltage generating circuit having first and second output terminals, the reference voltage generating circuit generating reference voltage based on external voltage, outputting the generated reference voltage from the first output terminal, generating a control signal used to control a current source and outputting the thus generated control signal from the second output terminal;

a voltage generating circuit whose input terminal is connected to the first output terminal of the reference voltage generating circuit, the voltage generating circuit lowering external power supply voltage according to the reference voltage supplied from the first output terminal of the reference voltage generating circuit to output internal power supply voltage from an output terminal thereof;

a first transistor having a current path connected between a terminal to which the external power supply voltage is supplied and the output terminal of the voltage generating circuit and a gate supplied with first voltage and having negative threshold voltage; and a second transistor having a current path connected between a terminal to which the external power supply voltage is supplied and the second output terminal of the reference voltage generating circuit and having negative threshold voltage, a gate of the second transistor being grounded.

17. The device according to claim 16, wherein the first voltage is one of ground voltage and voltage of a signal supplied from the second output terminal of the reference voltage generating circuit.

18. The device according to claim 16, wherein the substrate of the first transistor is connected to the output terminal of the voltage generating circuit.

19. The device according to claim 16, wherein the substrate of the second transistor is connected to one of the ground node and the second output terminal of the reference voltage generating circuit.

20. The device according to claim 16, further comprising a third transistor having a current path connected between the terminal to which the external power supply voltage is supplied and the first output terminal of the reference voltage generating circuit and having negative threshold voltage, a gate of the third transistor being connected to one of the ground node and the second output terminal of the reference voltage generating circuit and a substrate thereof being connected to the first output terminal of the reference voltage generating circuit.

* * * * *